US011730255B1

(12) United States Patent
Rubenzer

(10) Patent No.: US 11,730,255 B1
(45) Date of Patent: Aug. 22, 2023

(54) ARTICLE HOLDER

(71) Applicant: Peter Jon Rubenzer, Frisco, TX (US)

(72) Inventor: Peter Jon Rubenzer, Frisco, TX (US)

( * ) Notice: Subject to any disclaimer, the term of this patent is extended or adjusted under 35 U.S.C. 154(b) by 0 days.

(21) Appl. No.: 17/699,647

(22) Filed: Mar. 21, 2022

Related U.S. Application Data

(63) Continuation-in-part of application No. 29/829,804, filed on Mar. 8, 2022, and a continuation-in-part of application No. 29/829,797, filed on Mar. 8, 2022.

(60) Provisional application No. 63/207,999, filed on Apr. 7, 2021.

(51) Int. Cl.
*A45F 5/02* (2006.01)

(52) U.S. Cl.
CPC ..... *A45F 5/021* (2013.01); *A45F 2200/0583* (2013.01); *A45F 2200/0591* (2013.01)

(58) Field of Classification Search
CPC ..... A45F 5/021; A45F 2003/144; A45F 5/02; A45F 2200/0575; A45F 5/00; A45F 2003/001; A45F 2005/023; Y10T 24/45052; A45C 2013/306
USPC ..... 224/667–668, 672–673, 256
See application file for complete search history.

(56) References Cited

U.S. PATENT DOCUMENTS 4,621,753 A * 11/1986 Ridings ..... A45F 5/02 224/904
6,405,865 B1 * 6/2002 Lin ..... B25G 1/085 206/374
6,497,352 B2 * 12/2002 Grover ..... A45F 5/02 224/678
7,007,352 B1 * 3/2006 Hill ..... F41C 33/041 24/522
7,080,430 B2 * 7/2006 Wemmer ..... A41D 13/0012 24/578.13
7,175,061 B2 * 2/2007 Dohn ..... A45F 5/021 224/678
7,526,842 B2 * 5/2009 Wemmer ..... A41F 1/00 24/578.13
7,866,515 B1 * 1/2011 Buis, III ..... F41C 33/041 224/198
8,087,560 B2 1/2012 Crye
8,196,792 B2 * 6/2012 Clifton, Jr. ..... F41C 33/046 224/678
9,173,436 B2 * 11/2015 Crye ..... A45F 3/14
9,480,328 B2 * 11/2016 Stevens ..... A45F 5/021
10,306,973 B2 * 6/2019 Evans ..... F42B 39/02
10,945,877 B2 * 3/2021 Smith ..... F25D 3/00
11,083,262 B2 8/2021 Zhang
(Continued)

*Primary Examiner* — Adam J Waggenspack
(74) *Attorney, Agent, or Firm* — Law Office of Sam Sokhansanj, PLLC

(57) ABSTRACT

An article holder having a first region with a first curvature, a second region, wherein the second region is continuously formed with the first region, and a third region having a pair of first openings, wherein the third region is continuously formed with the second region. In addition, the second region can include a pair of second openings. The first region can include a third opening. The first region can be at an angle relative to a vertical plane. Further, the first curvature of the first region can extend the length of the first region. In addition, the first region can include a first and second side that at least partially extend outwards from the center of the first region. Further, one side of the first region can include a second curvature that at least partially corresponds to the first curvature of the second region.

20 Claims, 10 Drawing Sheets

(56) References Cited

U.S. PATENT DOCUMENTS

| | | | | |
|---|---|---|---|---|
| 11,085,716 | B2 | 8/2021 | Zhang | |
| 2007/0241159 | A1* | 10/2007 | Chang | A45F 5/021 224/904 |
| 2008/0313861 | A1* | 12/2008 | Clifton, Jr. | F41C 33/041 24/3.12 |
| 2011/0042533 | A1* | 2/2011 | Austin | A45F 5/02 248/220.21 |
| 2013/0318681 | A1* | 12/2013 | Schuh | A41D 13/0058 2/102 |
| 2021/0348880 | A1 | 11/2021 | Zhang | |

* cited by examiner

ARTICLE HOLDER

CROSS REFERENCE TO RELATED APPLICATIONS

This application claims the benefit of U.S. Provisional Application No. 63/207,999 filed Apr. 7, 2021. This application is a continuation-in-part (CIP) of U.S. Non-Provisional application Ser. No. 29/829,797 filed Mar. 8, 2022, which is incorporated herein by reference in its entirety. This application is a continuation-in-part (CIP) of U.S. Non-Provisional application Ser. No. 29/829,804 filed Mar. 8, 2022, which is incorporated herein by reference.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Many active occupations, sports, or leisurely activities require a person to have any number of specialized tools, supplies, and materials on their person for ready use at any time. For example, soldiers and police officers must typically carry weapons, ammunition, ammunition magazines, lights, food, radios and beverage, etc. on their person. Yet in most situations there is a desire to avoid the carriage of extraneous items which might unnecessarily reduce the speed, agility, and endurance of the carrier. Various accessory systems are known for attaching pouches and other elements to belts, vests, or other garments. Yet many of the arrangements which allow a user to clip-on and clip-off a pouch from a belt are heavy, complicated, time consuming, uncomfortable, or prone to breakage. In particular, many of these clip-on type devices are highly unsecure on the person's clothing/belt and can easily detach. Further, with respect to larger clip-on style accessory holders worn around the waist, they can be very uncomfortable to wear for a prolonged period of time as the general configuration of the holder does not conform to the user's waist or hip area.

Hence, what is needed is a load or accessory carrying paddle holder that is structurally secure, easy to put on, can hold a large amount of weight, is comfortable to wear all day long and can interface with Modular Lightweight Load-Carrying Equipment (MOLLE).

BRIEF SUMMARY

In one aspect of the disclosure described herein, a load or accessory carrying paddle holder that is structurally secure, easy to put on, can interface with Modular Lightweight Load-Carrying Equipment (MOLLE), can hold a large amount of weight, and is comfortable to wear all day long. In particular, an article holder is disclosed having a first region having a first curvature; a second region, wherein the second region is continuously formed with the first region; and a third region having a pair of first openings, wherein the third region is continuously formed with the second region. In addition, the second region can include a pair of second openings. The first region can include a third opening. The first region can be at an angle relative to a vertical plane. Further, the first curvature of the first region can extend the length of the first region. In addition, the first region can include a first and second side that at least partially extend outwards from the center of the first region. Further, one side of the first region can include a second curvature that at least partially corresponds to the first curvature of the second region. In addition, the first pair of openings of the third region can each include a rectangular shape. Further, the second pair of openings of the second region can each include a rectangular shape. The article holder can also include a pair of projections disposed on an inner surface of the first region.

In another aspect of the disclosure described herein, an article holder is disclosed that can include a first region having a first curvature; a second region having a first pair of openings, wherein the second region is continuously formed with the first region; and a third region, wherein the third region is continuously formed with the second region. In addition, the second region can at least partially extend away from the third region. Further, the third region can include an extension member, wherein the extension member comprises a second pair of openings. Also, the first region can be at an angle relative to a vertical plane. In addition, the first curvature of the first region can extend the length of the first region. Further, the first region can include a first and second side that at least partially extend outwards from the center of the first region. Further, one side of the first region can include a second curvature that at least partially corresponds to the first curvature of the second region. In addition, a pair of projections can be disposed on an inner surface of the first region.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
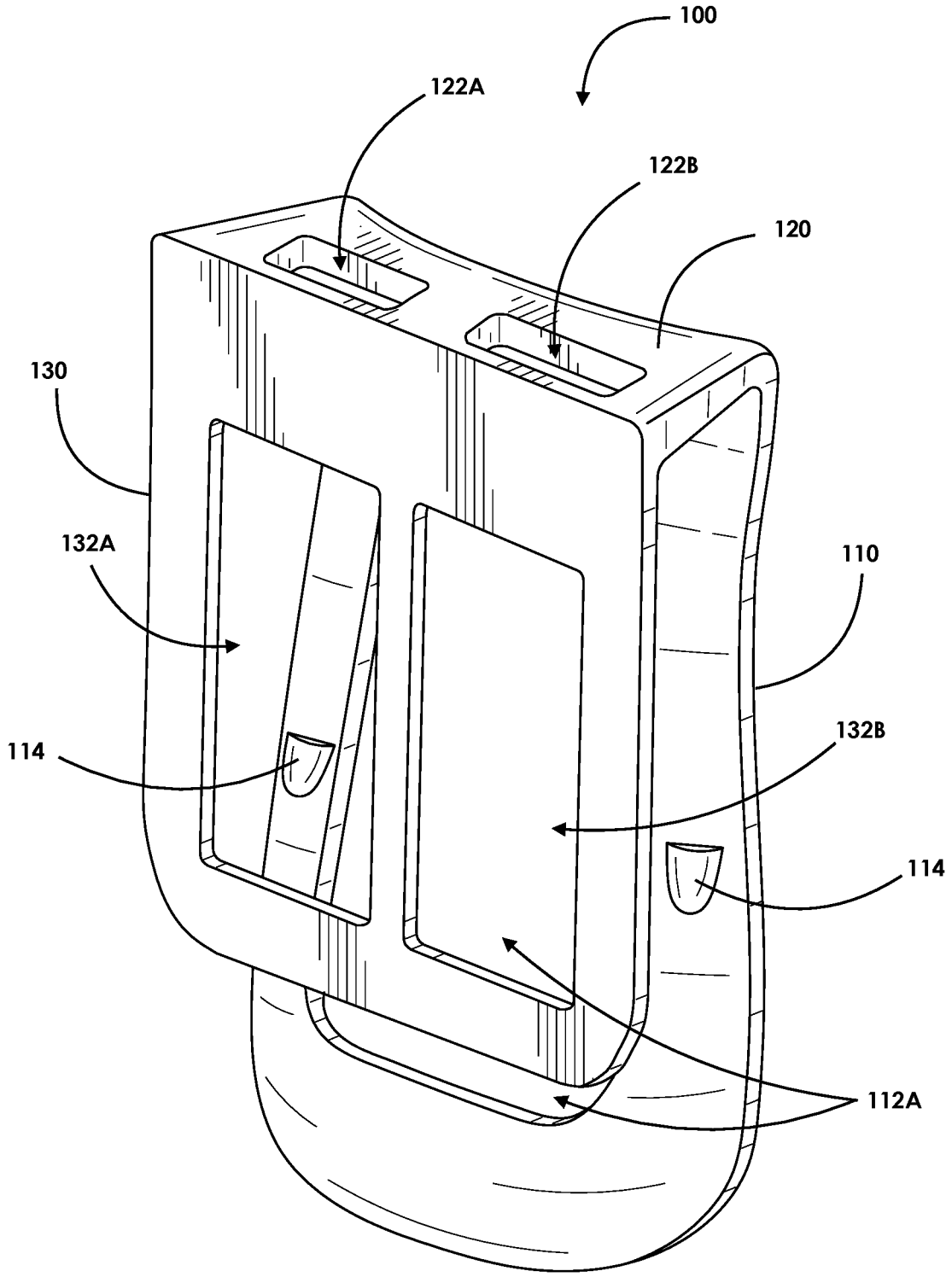
FIG. 1 illustrates a perspective view of the article holder according to one non-limiting exemplary embodiment of the disclosure described herein.
Figure 2A:
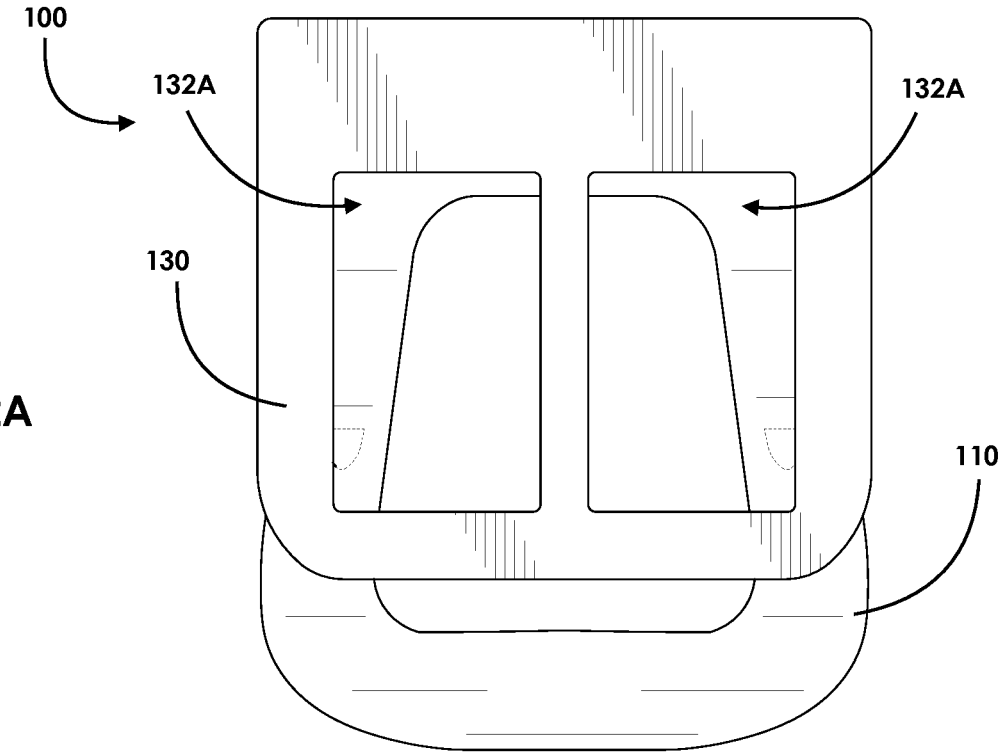
FIG. 2A illustrates a front view of the article holder of FIG. 1.
Figure 2B:
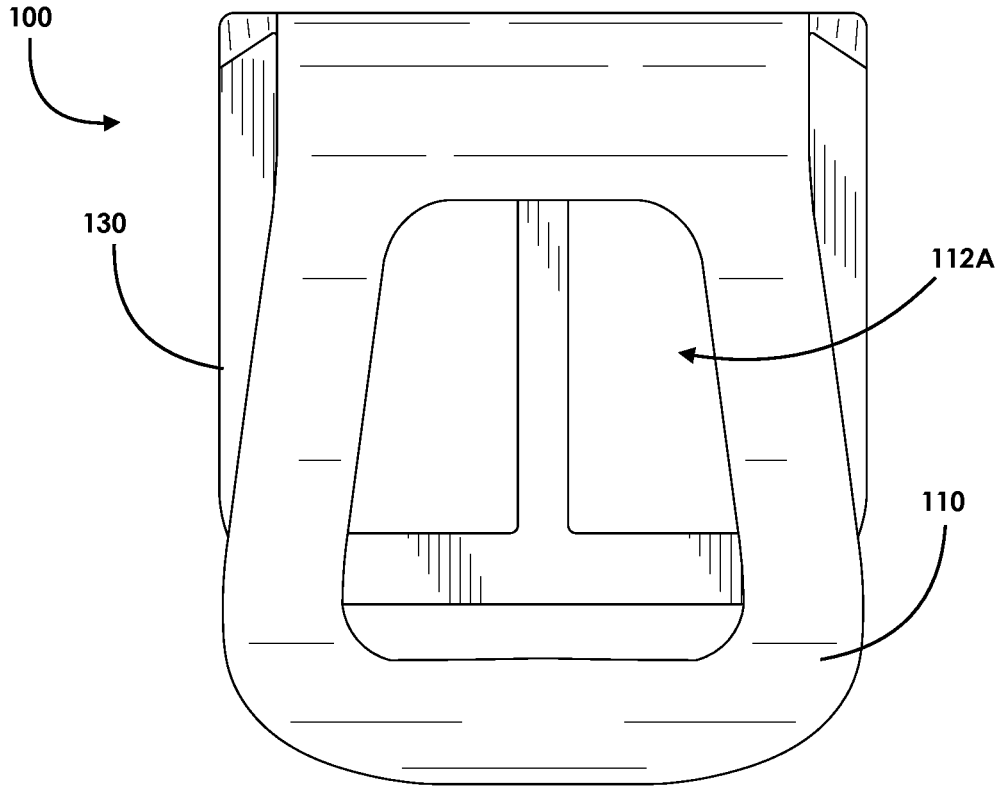
FIG. 2B illustrates a rear view of the article holder of FIG. 1.
Figure 3A:
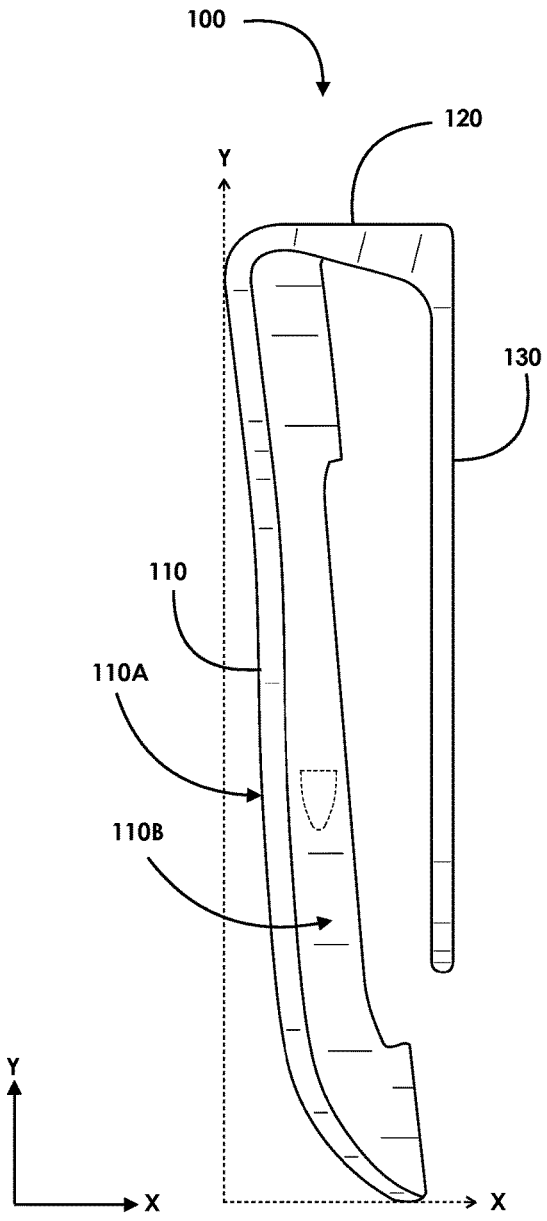
FIG. 3A illustrates a right side view of the article holder of FIG. 1.
Figure 3B:
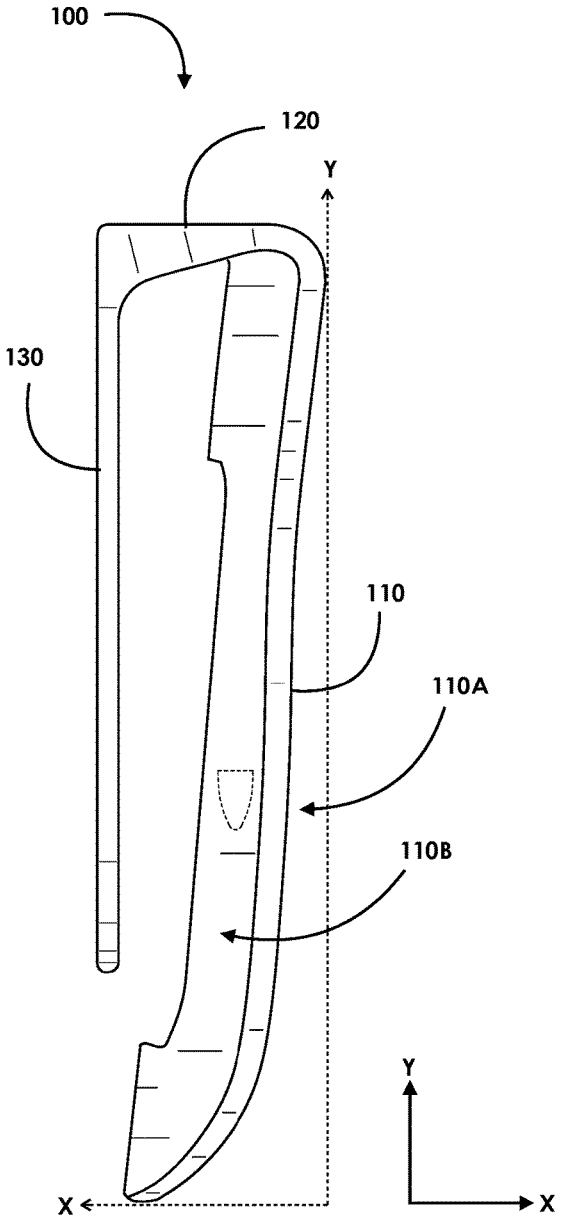
FIG. 3B illustrates a left side view of the article holder of FIG. 1.
Figure 4A:
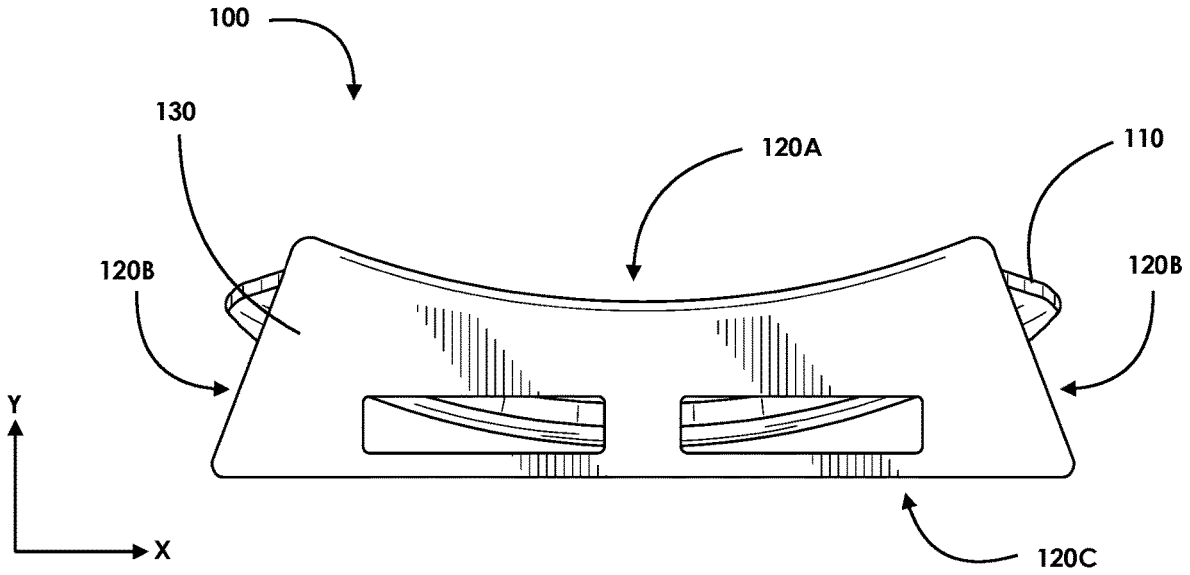
FIG. 4A illustrates a top view of the article holder of FIG. 1.
Figure 4B:
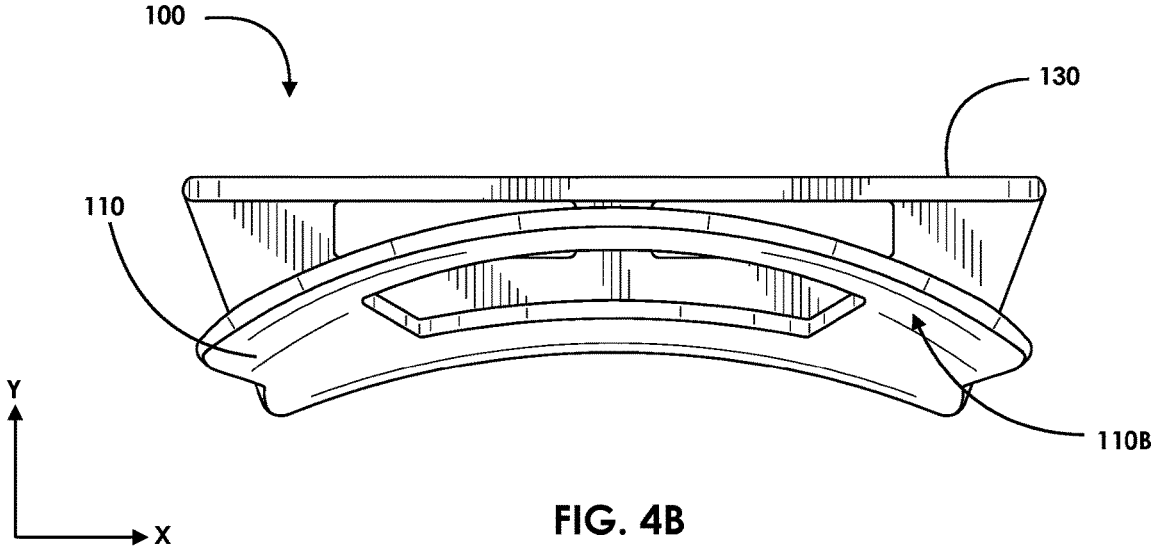
FIG. 4B illustrates a bottom view of the article holder of FIG. 1.
Figure 5:
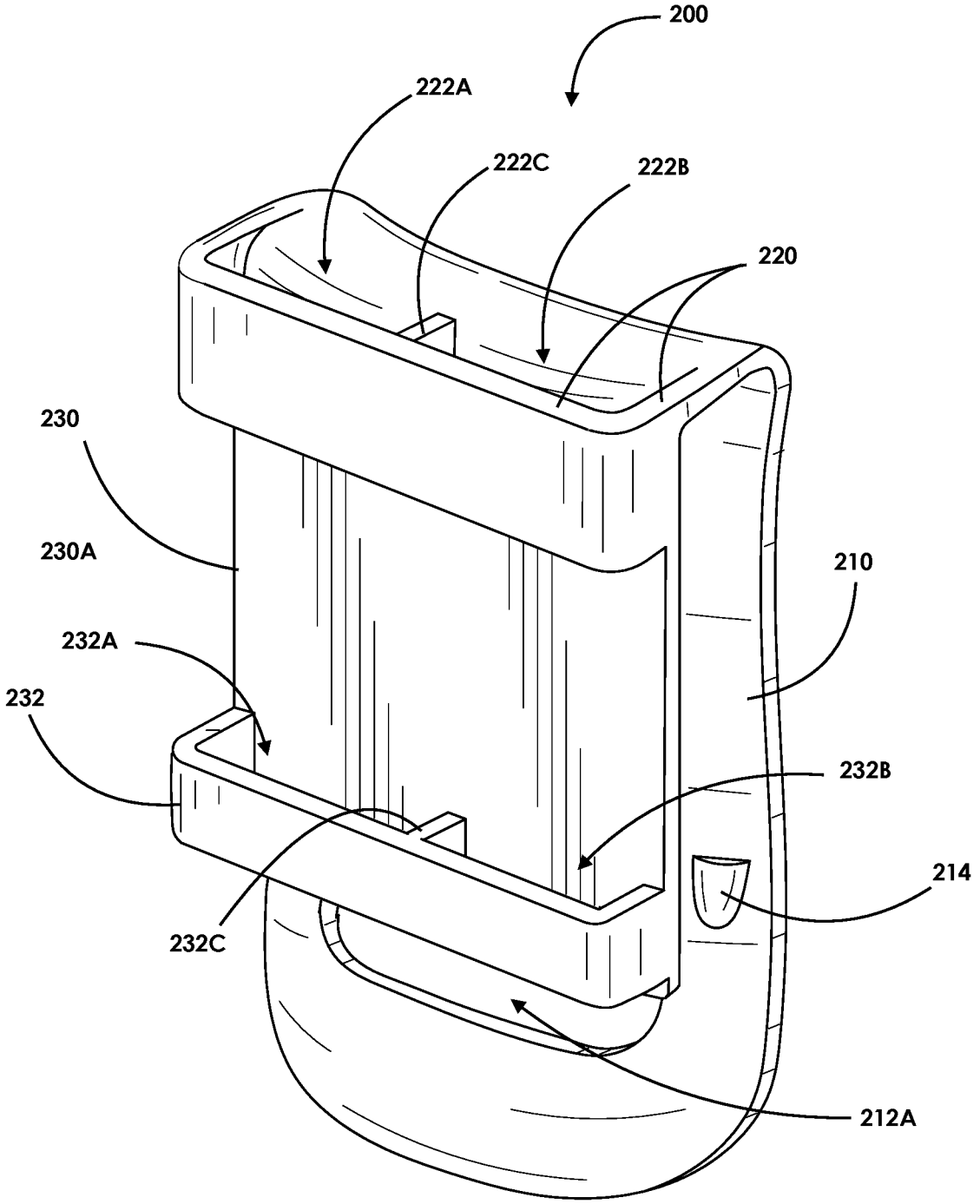
FIG. 5 illustrates a perspective view of the article holder according to another non-limiting exemplary embodiment of the disclosure described herein.
Figure 6A:
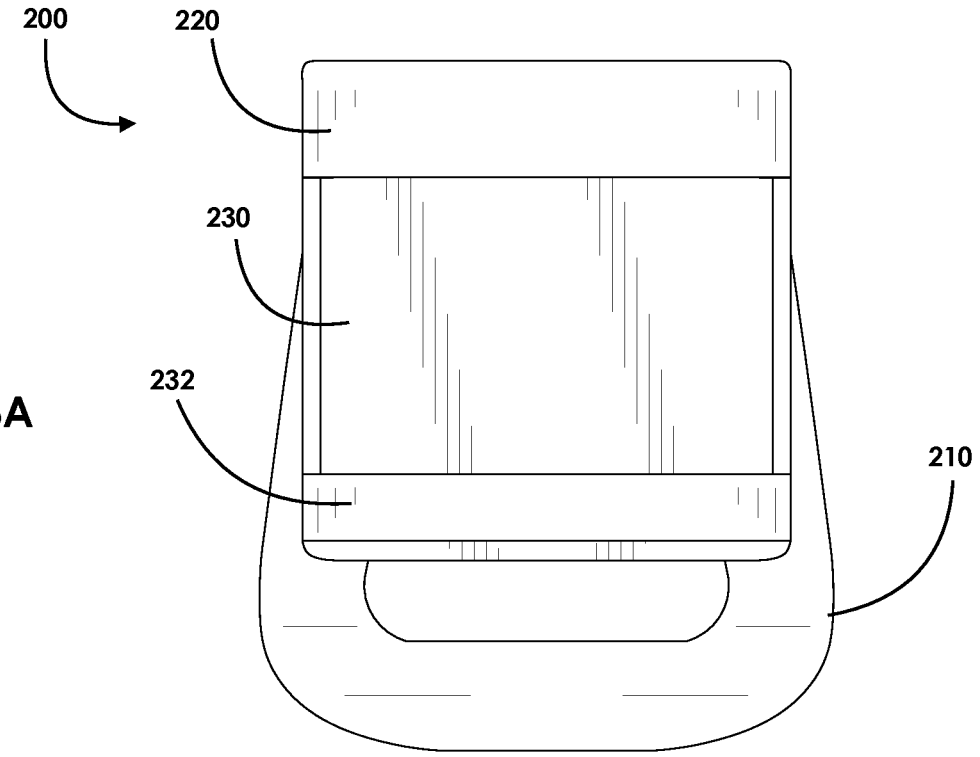
FIG. 6A illustrates a front view of the article holder of FIG. 5.
Figure 6B:
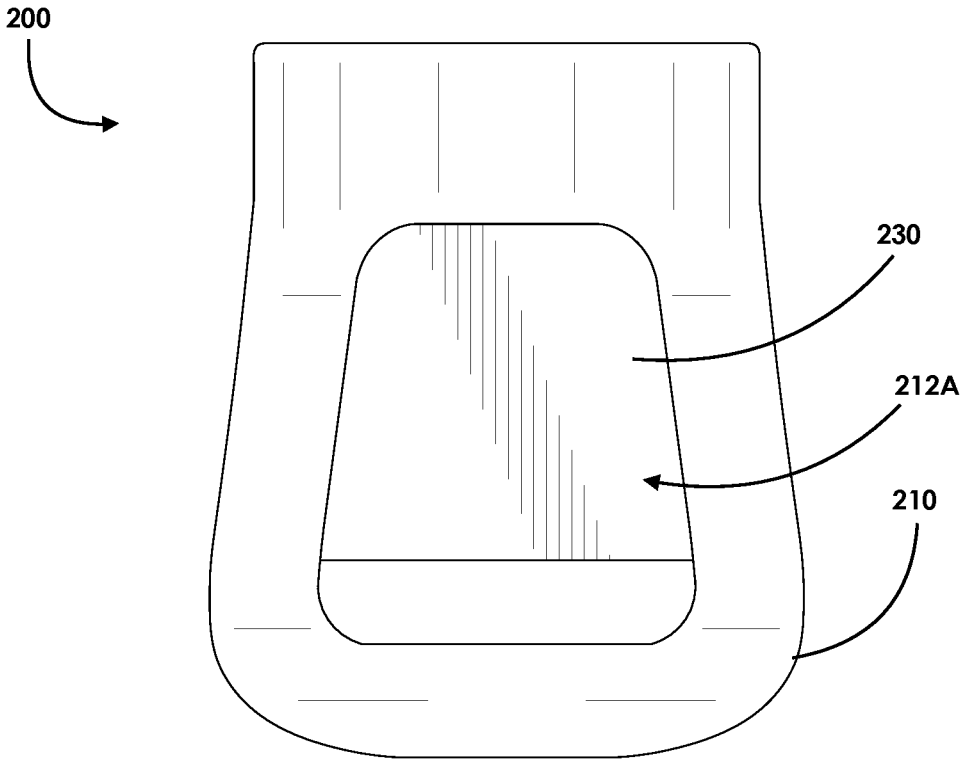
FIG. 6B illustrates a rear view of the article holder of FIG. 5.
Figure 7A:
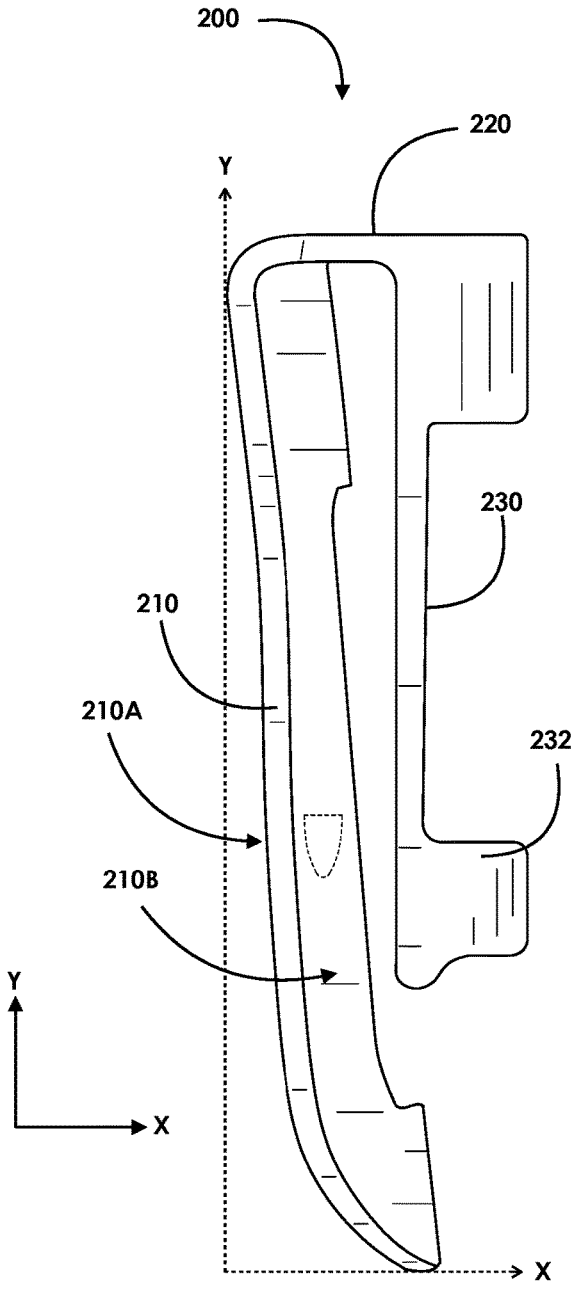
FIG. 7A illustrates a right side view of the article holder of FIG. 5.
Figure 7B:
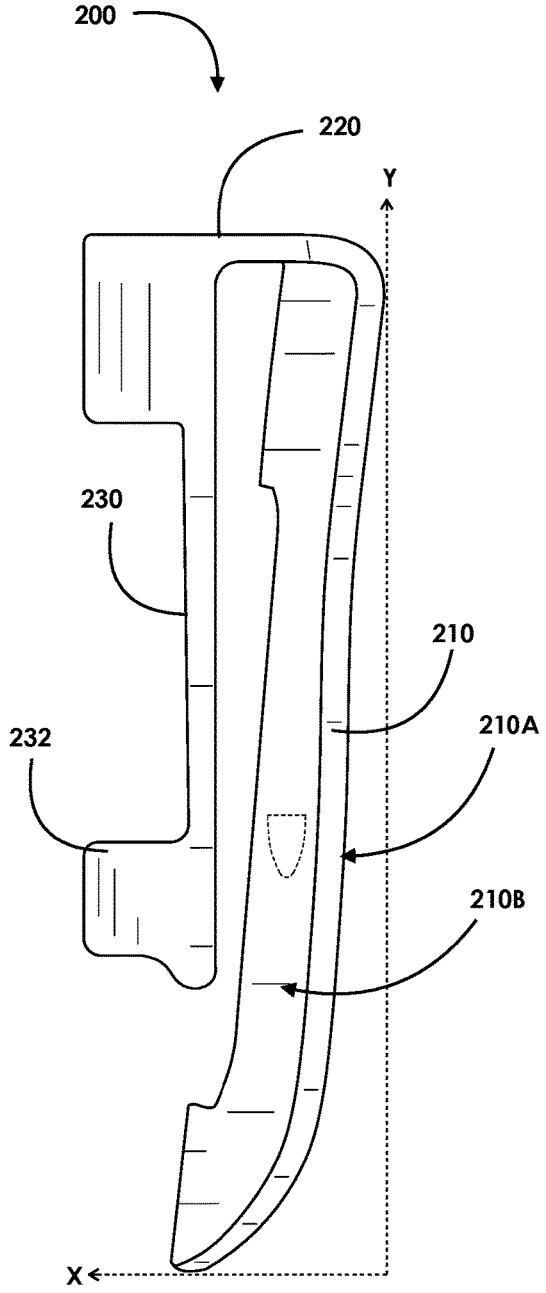
FIG. 7B illustrates a left side view of the article holder of FIG. 5.
Figure 8A:
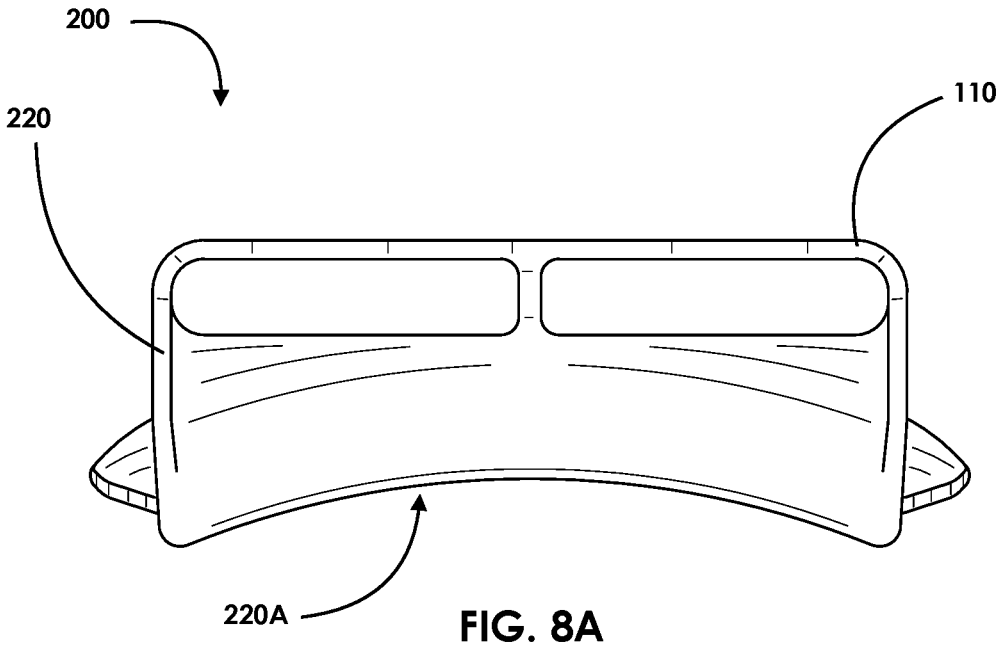
FIG. 8A illustrates a top view of the article holder of FIG. 5.
Figure 8B:
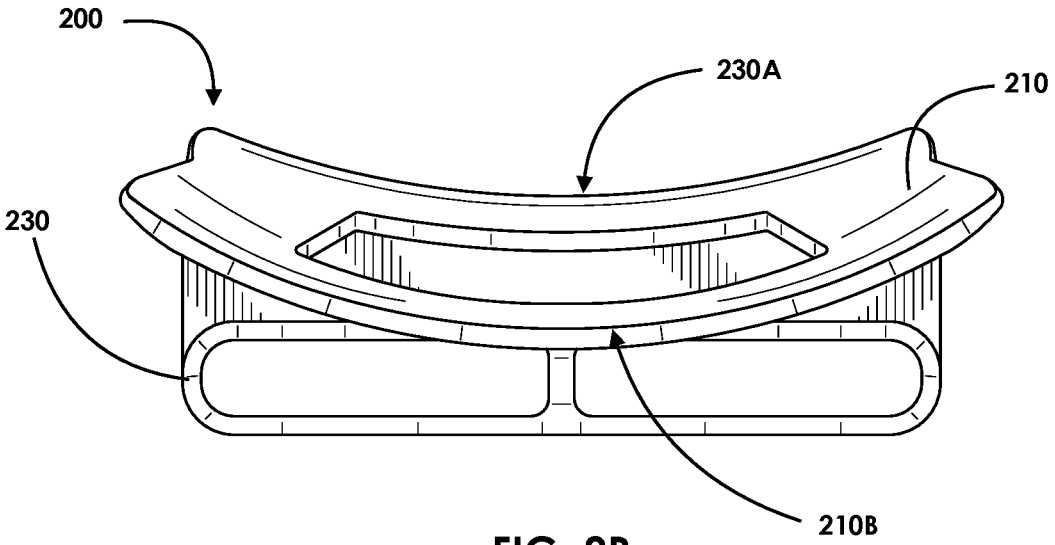
FIG. 8B illustrates a bottom view of the article holder of FIG. 5.

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

FIGS. 1-4B illustrate one non-limiting exemplary embodiment of the article holder 100 of the disclosure described herein. Here, it is contemplated within the scope of the present disclosure described herein that holder 100 may be adapted to carry any type of load, accessory, article, device, or apparatus, including but not limited to holsters, bags, sleeves, pouches, tactical modular equipment, MOLLE, and the like. In addition, holder 100 can be provided in various sizes and be worn about any area of the person, such as the waist, hip, leg, arm, or chest, among others, and be further secured to any article or clothing, such as a belt, belt loops, clips, carabiners, or any loop or clothing extension, among others. In addition, holder 100 may also be adapted to couple or be secured to additional holders 100 or 200, such as in a layered or stacked configuration. As shown with respect to FIGS. 1-4B, holder 100 includes an angled first region 110 followed by a horizontal second region 120 and a vertical third region 130, wherein regions 110, 120, and 130 are integrated and conformed together in a continuous unitary one-piece configuration. Here, region 110 is generally comprised of a paddle having a curved surface that can be inserted inside a person's pants or belt around or about either the left or right side waist or hip region. Specifically, as shown in FIGS. 3A-4B, the outer surface 110A or region 110 is shown to be offset or at varying angles relative to a vertical axis or plane. Here, the general shape and configuration of the varying angles of surface 110A allows region 110 to comfortably fill the contour or adapt to the side hip or waist area of a person, generally following the person's side waist and hip anatomy and allowing it to conform thereto. In addition, region 110 further includes an arched or curved outer and inner surface 110B that further conforms to the side of the user's hip, waist, and leg, and further adapt and conform to the contour of the side hip or waist area. It is contemplated within the scope of the present disclosure described herein that region 110 of holder 100 may be flexible, semi-rigid, or rigid. In the alternative, if holder 100 is worn around a person's arm, leg, or chest, surfaces 110A and 110B of region 110 can further conform to the arched or curved surface or anatomy of the person's arm, leg, or chest areas, among other locations.

Still referring to FIGS. 1-4B, region 110 can also include an opening 112A therein, which helps region 110 to flex and bend to better conform to the user's hip or waist, among other locations. In alternative, any belt, strap, or looped article can be further routed or directed through opening 112A of region 110 for better securement of holder 100 onto the user or person. In addition, opening 112A can provide access for injection molding during manufacturing of the device. In addition, region 110 may also include a pair of nubs or protrusions 114 having a top ledge that allow a bottom edge region of a user's belt to be supported thereon and can further operate as guides for the user's belt. In particular, protrusions 114 can further help to prevent holder 100 from detaching from the user's side when holder 100 is secured by the user's belt or waist band. Further, as shown, region 110 conforms to a substantially horizontal region 120 at the top area of holder 100. Specifically, region 120 includes openings 122A and 122B that allow any type of accessory or article to be secured to holder 100. Specifically, any type of a securement member, such as a loop, band, strap, MOLLE strap, rope, string, chain, hook, or clip, can be routed, threaded, or directed through rectangular shaped openings 122A and 122B in order to allow the securement member to be secured to holder 100, either alone or in combination with openings 132A and 132B of region 130. As shown in FIG. 4A, region 120 is shown having a curvature area 120A followed by sloped or slanted side areas 120B that are further followed by a straight or flat area 120C. In particular, curvature area 120A at least partially or substantially follows the curvature 110B of region 110. Here, region 120 further conforms to the substantially vertical region 130. In particular, region 130 includes a pair of rectangular shaped openings 132A and 132B. Here, openings 132A and 132B allow any type of accessory or article to be secured to holder 100. Specifically, any type of a securement member, such as a loop, band, strap, MOLLE strap, rope, string, chain, hook, or clip, can be routed, threaded, or directed through rectangular shaped openings 132A and 132B in order to allow the securement member to be secured to holder 100, either alone or in combination with openings 122A and 122B of region 120.

FIGS. 5-8B illustrate another non-limiting exemplary embodiment of the article holder 200 of the disclosure described herein. Here, it is contemplated within the scope of the present disclosure described herein that holder 200 may be adapted to carry any type of load, accessory, article, modular equipment, MOLLE, device, or apparatus, including but not limited to holsters, bags, sleeves, pouches, and the like. In addition, holder 200 can be provided in various sizes and be worn about any area of the person, such as the waist, hip, leg, arm, or chest, among others, and be further secured to any article or clothing, such as a belt, belt loops, clips, carabiners, or any loop or clothing extension, among others. In addition, holder 200 may also be adapted to couple or be secured to additional holders 200 or 100, such as in a layered or stacked configuration. As shown with respect to FIGS. 5-8B, holder 200 includes an angled first region 210 followed by a top second region 220 that extends outward and a vertical third region 230 having an extension member 232, wherein regions 210, 220, 230, and member 232 are integrated and conformed together in a continuous unitary one-piece configuration. Here, region 210 is generally comprised of a paddle having a curved surface that can be inserted inside a person's pants or belt around or about either the left or right side waist or hip region. Specifically, as shown in FIGS. 5A-5B, the outer surface 210A of region 210 is shown to be offset or at varying angles relative to a vertical axis. Here, the general shape and configuration of the varying angles of surface 210A allows region 210 to comfortably fill the contour or adapt to the side hip or waist area of a person, generally following the person's side waist and hip anatomy and allowing it to conform thereto. It is contemplated within the scope of the present disclosure described herein that region 210 of holder 200 may be flexible, semi-rigid, or rigid. In addition, region 210 further includes an arched or curved outer and inner surface 210B that further conforms to the side of the user's hip, waist, and leg, and further adapts and conforms to the contour of the side hip or waist area. In the alternative, if holder 200 is worn around a person's arm, leg, or chest, surfaces 210A and 210B of region 210 can further conform to the arched or curved surface or anatomy of the person's arm, leg, or chest areas, among other locations.

Still referring to FIGS. 5-8B, region 210 can also include an opening 212A therein, which helps region 210 to flex and bend to better conform to the user's hip or waist, among other locations. In the alternative, any belt, strap, or looped article can be further routed or directed through opening 212A of region 210 for better securement of holder 200 onto the user or person. In addition, opening 212A can provide access for injection molding during manufacturing of the device. In addition, region 210 may also include a pair of nubs or protrusions 214 having a top ledge that allow a bottom edge region of a user's belt to be supported thereon and can further operate as guides for the user's belt. In particular, protrusions 214 can further help to prevent holder 200 from detaching from the user's side when holder 200 is secured by the user's belt or waistband. Further, as shown, region 210 conforms to a region 220 at the top area of holder 200. Specifically, region 220 includes an extending member that further includes openings 222A and 222B that allow any type of accessory or article to be secured to holder 200, among others. In addition, region 220 can further include a divider member 222C that separates openings 222A and 222B, and can further provide additional structural rigidity to holder 200. Specifically, any type of a securement member, such as a loop, band, strap, MOLLE strap, rope, string, chain, hook, or clip, can be routed, threaded, or directed through openings 222A and 222B in order to allow the securement member to be secured to holder 200, either alone or in combination with openings 232A and 232B of extension member 232 of region 230. As shown in FIG. 8A, region 220 is shown having a curvature area 220A. In particular, curvature area 220A at least partially or substantially follows the curvature 210B of region 210. Here, region 220 further conforms to the substantially vertical region 230. In particular, region 130 includes an extension member 232 that further includes a pair of openings 232A and 232B, wherein the size and orientation of openings 232A and 232B are axially aligned with that of openings 222A and 222B. In addition, openings 232A and 232B may also be separated via a dividing member 232C, wherein the dividing member 232C can further provide structural rigidity to holder 200. Here, openings 232A and 232B can allow any type of accessory or article to be secured to holder 200. Specifically, any type of a securement member, such as a loop, band, strap, MOLLE strap, rope, string, chain, hook, or clip, can be routed, threaded, or directed through openings 232A and 232B in order to allow the securement member to be secured to holder 200, either alone or in combination with openings 222A and 222B of region 220.

Figure 9:
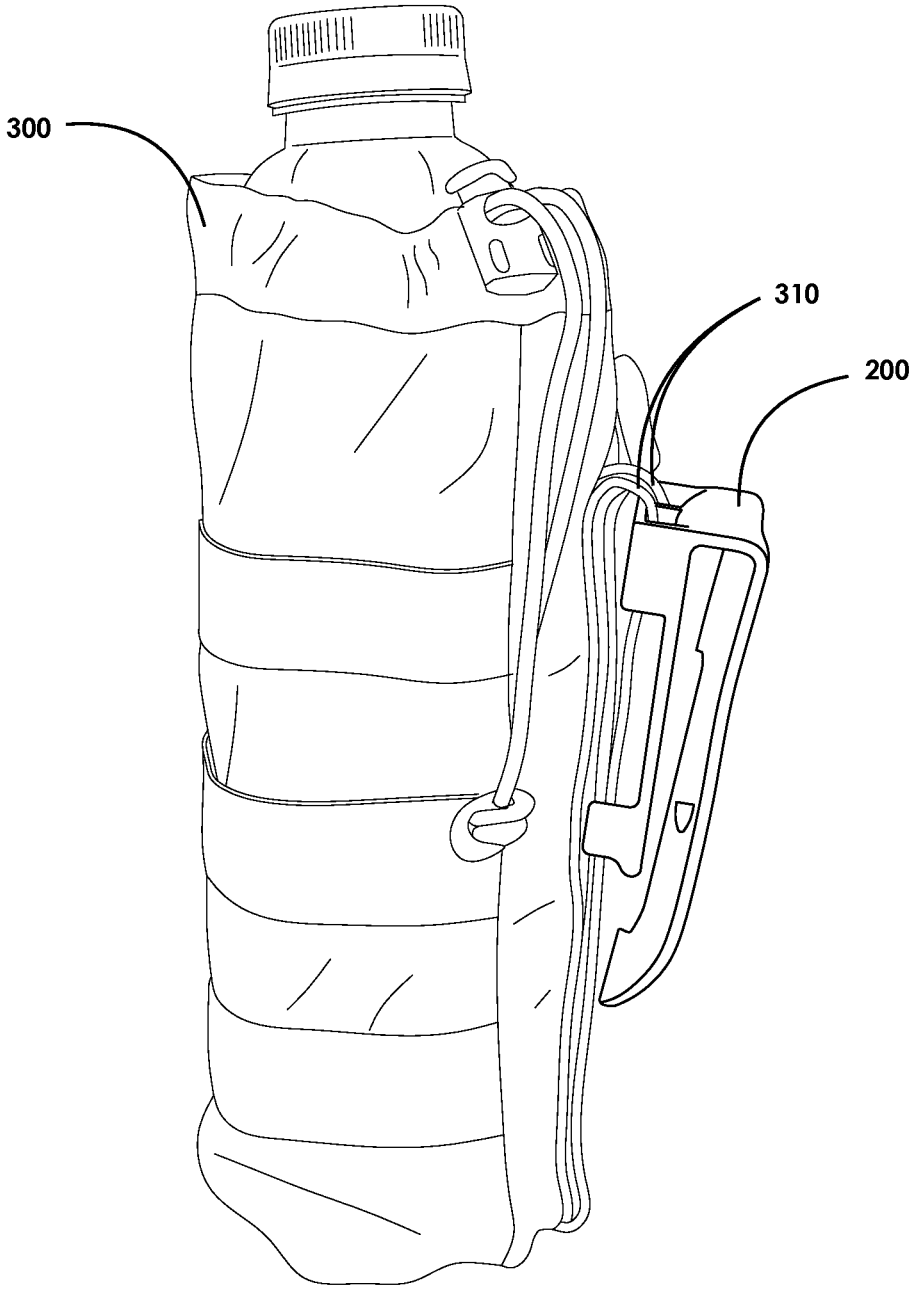
FIG. 9 illustrates a perspective side view of the article holder of FIG. 5 secured to article, according to another non-limiting exemplary embodiment of a method of use of the disclosure described herein.
Figure 10:
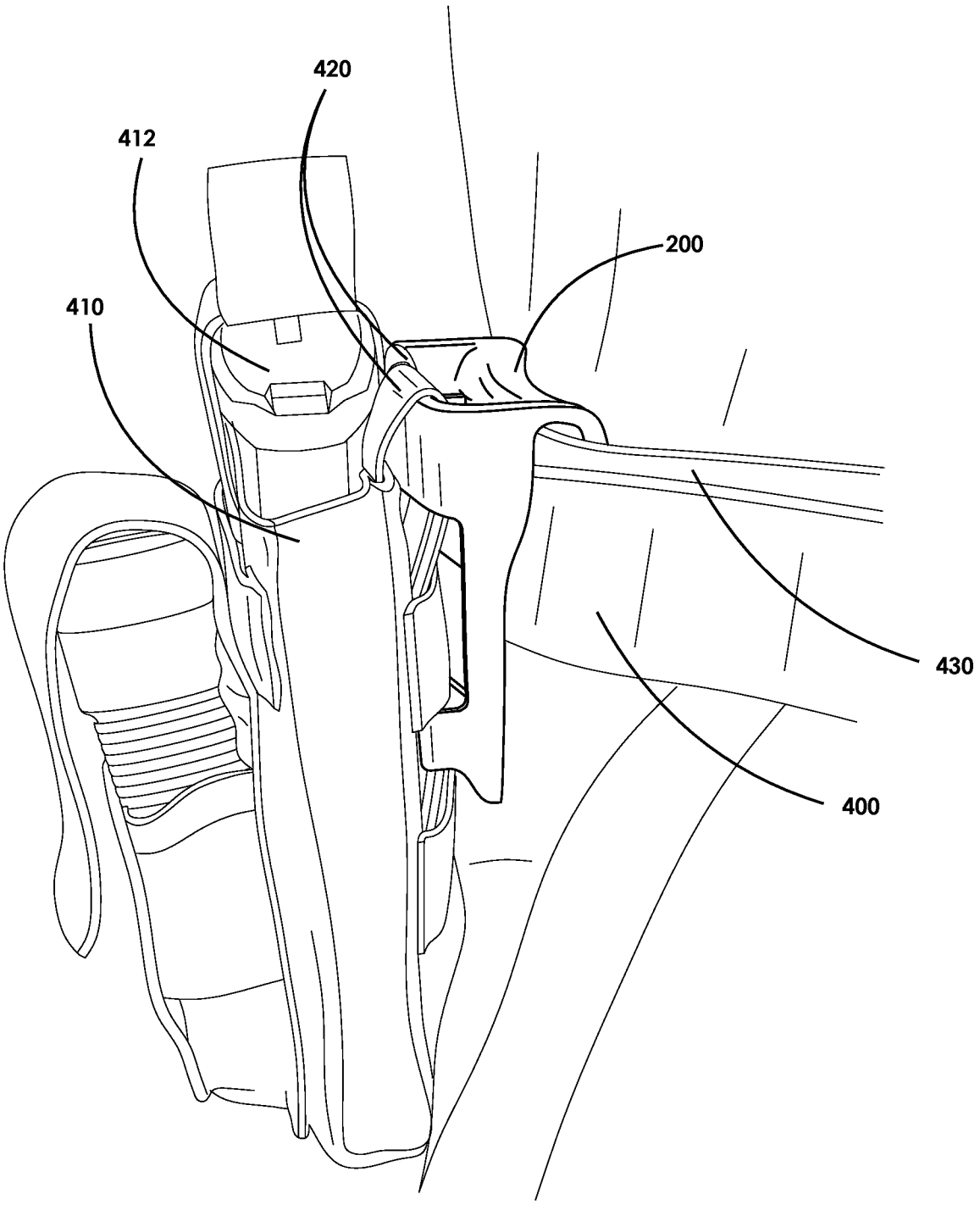
FIG. 10 illustrates a perspective side view of the article holder of FIG. 5 as worn on a person, according to non-limiting exemplary embodiment of a method of use of the disclosure described herein.

FIG. 9 illustrates one non-limiting exemplary embodiment of a method of use of holder 200, which can be similar to that of holder 100. Specifically, any type of article, such as MOLLE pouch 300 for holding a water bottle having straps 310 can be routed or directed through openings 222A, 222B, 232A, and 232B of holder 200 (and further tied or secured to the holder or the pouch itself), thereby securing pouch 300 to holder 200. Similarly, FIG. 10 illustrates another non-limiting exemplary embodiment of a method of use of holder 200, which can be similar to that of holder 100. Here, region 210 is shown being inserted within the waistline of a pair of pants, shorts, or undergarment (in between the waist band 430 of the garment and a shirt/undergarment or between the waist band 430 and the skin (body) of the user, wherein the curved surface of region 210 conforms to the side of the user. Alternatively, region 210 of holder 200 can be inserted between 400 and the waist band 430 of the user, wherein holder is supported and secured (and hung) via the user's belt 400. In addition, any one or more of straps 420 of MOLLE magazine pouch 410 (for holding ammunition magazine 412) can be routed or directed through openings 222A, 222B, 232A, and 232B of holder 200 (and further tied or secured to the holder or the MOLLE ammunition magazine pouch itself), thereby securing ammunition magazine pouch 410 to holder 200.

It is contemplated within the scope of the present disclosure described herein that either of holders 100 or 200 can be made of any material, including but not limited to plastics, polycarbonate, any polymer-based material, fiberglass, metal, or wood, or wood composite, among others. In addition, it is contemplated within the scope of the present disclosure described herein that any of holders 100 or 200 may be made via any type of manufacturing method, including injection molding and 3D printing. In addition, it is contemplated within the scope of the present disclosure described herein that any of holders 100 or 200 may made as one unitary (single piece) component, or multiple components integrated, fused, or secured together. For example, any one or more of the aforementioned components 110-232C may be independent parts secured together.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. An article holder, comprising:

an attachment clip, further comprising:

a first member having an arched surface, wherein the first member comprises a first opening having a substantially trapezoidal configuration;

a second member, wherein the second member and first member are at an acute angle relative to each other, wherein the second member comprises a first extension, the first extension having a pair of second openings each in a substantially rectangular configuration, wherein each of the second openings comprises a curved region therein, wherein the curved region extends from the second member and merges with a third member within each of the second openings; and the third member opposing the first member, wherein the third member comprises a second extension, the second extension having a pair of third openings each in a substantially rectangular configuration.

2. The article holder of claim 1, wherein the second openings are axially aligned with the third openings.

3. The article holder of claim 1, wherein the second openings are each comprised of a rounded rectangular configuration.

4. The article holder of claim 1, wherein the arched surface is symmetrical and the first opening is disposed within the arched surface.

5. The article holder of claim 1, wherein the arched surface extends to the width of the first member.

6. The article holder of claim 1, wherein the first member comprises a first region and a second region, wherein the first region is sloped relative to the second region.

7. The article holder of claim 1, wherein the second openings are disposed above the third openings.

8. The article holder of claim 1, wherein the first extension is monolithically formed with the second member.

9. The article of holder of claim 1, wherein the first extension is monolithically formed with the second member.

10. The article holder of claim 1, further comprising a pair of protrusions disposed on an inner surface of the first member.

11. An article holder, comprising:

a clip, further comprising:

a first member having a surface that is tangential to a first plane, the first member having an arched surface, wherein the first member comprises a first opening;

a second member disposed within a second horizontal plane independent of the first plane of the first region, wherein the second member comprises a first projecting member, the first projecting member having a pair of second openings each in a substantially rectangular configuration, wherein the second member is monolithically formed with the first member, and wherein the first member and second member merge within the pair of second openings; and a third member within a third vertical plane, wherein the third member comprises a second projecting member, the second projecting member having a pair of third openings each in a substantially rectangular configuration, and wherein the third member is formed with the second member.

12. The article holder of claim 11, wherein the second member is disposed above the third region.

13. The article holder of claim 11, wherein the first projecting member is axially aligned with the second projecting member.

14. The article holder of claim 11, wherein the first member is at an angle relative to a vertical plane.

15. The article holder of claim 11, wherein the arched surface extends to the width of the first member.

16. The article holder of claim 11, wherein the first member comprises a first and second side, wherein the first and second side of the first member each comprise a sloped configuration relative to a vertical plane at the center of the first member.

17. The article holder of claim 11, wherein the second openings of the first projecting member are axially aligned with the third openings of the second projecting member.

18. The article holder of claim 11, further comprising a pair of protrusions disposed on an inner surface of the first member.

19. An article holder, comprising:

a clip comprising a base member having a symmetrical curvature;

the clip further comprising a first protruding member comprising a pair of first openings, wherein each of the first openings are formed via a first divider within the first protruding member, wherein each of the first openings are in a substantially rectangular configuration, and a curved region disposed within the first protruding member; and the clip further comprising a second protruding member comprising a pair of second openings, wherein each of the second openings are formed via a second divider within the second protruding member, and wherein each of the second openings are in a substantially rectangular configuration.

20. The article holder of claim 19, wherein the first openings of the first protruding member are axially aligned with the second openings of the second protruding member.

* * * * *